US006062586A

United States Patent [19]

Korman

[11] Patent Number: 6,062,586

[45] **Date of Patent: *May 16, 2000**

[54] BOOT BINDING SYSTEM FOR A SNOWBOARD

[76] Inventor: Nathan M. Korman, 6003½ Winans, Los Angeles, Calif. 90068

[ * ] Notice: This patent is subject to a terminal disclaimer.

[21] Appl. No.: 09/087,874

[22] Filed: Jun. 1, 1998

Related U.S. Application Data

[63] Continuation-in-part of application No. 08/931,099, Sep. 15, 1997, Pat. No. 5,941,553.

[51] Int. Cl.[7] ..... A63C 9/08

[52] U.S. Cl. ..... 280/613; 36/117.3; 280/617; 280/14.2

[58] Field of Search ..... 280/613, 614, 280/617, 631, 14.2, 618; 36/115, 117.1, 117.2, 117.3

[56] References Cited

U.S. PATENT DOCUMENTS

| | | | |
|---|---|---|---|
| 2,693,967 | 11/1954 | Jones, Jr. | 280/613 |
| 3,061,325 | 10/1962 | Glass | 280/613 |
| 3,992,037 | 11/1976 | Frechin | 280/613 |
| 4,177,584 | 12/1979 | Beyl | 280/613 X |
| 4,418,937 | 12/1983 | Salomon | 280/613 |
| 4,728,115 | 3/1988 | Pozzobon et al. | 280/613 |
| 4,964,649 | 10/1990 | Chamberlain | 280/618 |
| 4,973,073 | 11/1990 | Raines et al. | 280/624 |
| 5,020,823 | 6/1991 | Bogner | 280/634 |
| 5,143,396 | 9/1992 | Shaanan et al. | 280/607 |
| 5,348,335 | 9/1994 | Dasarmaux et al. | 280/633 |
| 5,362,087 | 11/1994 | Agid | 280/611 |
| 5,401,041 | 3/1995 | Jespersen | 280/14.2 |
| 5,413,372 | 5/1995 | Evans et al. | 280/620 |
| 5,474,322 | 12/1995 | Perkins et al. | 280/613 |
| 5,503,414 | 4/1996 | Teeter et al. | 280/14.2 |
| 5,505,477 | 4/1996 | Turner et al. | 280/613 |
| 5,505,478 | 4/1996 | Napoliello | 280/618 |
| 5,520,406 | 5/1996 | Anderson et al. | 280/624 |
| 5,564,719 | 10/1996 | Kisselmann | 280/14.2 |
| 5,595,396 | 1/1997 | Bourdeau | 280/613 |
| 5,660,410 | 8/1997 | Alden | 280/14.2 X |

*Primary Examiner*—Michael Mar
*Attorney, Agent, or Firm*—Jack C. Munro

[57] ABSTRACT

A boot binding apparatus for a snowboard where the snowboard boot includes a first securement in the form of a front hook member and a second securement in the form of a rear hook member which are imbedded within the sole of the snowboard boot. The snowboard boot is flexible in order to bend in the same manner as a conventional soft boot. The boot binding apparatus includes a front latching mechanism and a rear latching mechanism with the front latching mechanism including a latching hook member with this latching hook member facing toward the toe edge of the snowboard. The rear latching mechanism is movable between a latching position and an unlatching position with the rear latching mechanism being continuously biased toward the latching position. The latching hook member of the front latching mechanism may also be movable and continuously biased in a direction toward the toe edge of the snowboard. With the snowboard boot engaging with the boot binding system, the sole of the snowboard boot is in direct flush contact with the upper surface of the boot binding apparatus being totally enclosed and protected from contamination by snow and debris while engaged.

9 Claims, 9 Drawing Sheets

20
21
22
24
26
28
29
30
32
34
36
38
40
42
44
46
48
50
52
54
56
58
60
62
66
70
72
76
78
82
92
96
98
100
102
108
112
114
116
118
120
122
124
128
132
136
142
146
148
152
156
156
174
176
2
2
3
3

150
52
122
140
124
126
142
100
128
148
56
54

140
124
126
122
116
144
142
148
128
138
132
136
60
76
74
52
58
54
56
128
136
132

BOOT BINDING SYSTEM FOR A SNOWBOARD

REFERENCE TO PRIOR APPLICATION

This application is deemed to be a continuation-in-part of patent application Ser. No. 08/931,099 filed Sep. 15, 1997 now U.S. Pat. No. 5,941,553 entitled BOOT BINDING APPARATUS FOR A SNOWBOARD by the present inventor.

BACKGROUND OF THE INVENTION

1) Field of the Invention

The field of this invention relates to recreational equipment and more particularly to a boot binding system between a snowboard boot and a snowboard which is designed to be maneuvered by a human across snow.

2) Description of the Prior Art

Snowboarding, as a sport, is discussed within the prior application Ser. No. 08/931,099 of which this application is a continuation-in-part. Also, the prior application has discussed the prior art of "step-in" bindings to which the structure of the present invention is directed.

Previously, within snowboard boots, there have been utilized soft boots, hard boots and more recently, for the purpose of "step-in" bindings, a hybrid boot that includes a stiff shank imbedded in the sole for retention and control. In the past, a soft boot has been used for freestyle and free riding, with hard boots being used for alpine and racing. In the past, if a soft boot has been used, the boot is attached to the snowboard by a strapping arrangement. Such a strapping arrangement does not permit a step-into and a step-out-of procedure in conjunction with the snowboard. The strapping arrangement requires the user to actually fasten the straps to secure the boot onto the snowboard. This type of securement procedure for the snowboard boot is time consuming with the release procedure also being time consuming.

The step-in procedure in the past has always been reserved for the hard type of boot and the hybrid boot. The inclusion of a stiff shank in the sole of a boot inherently makes the boot less comfortable when being worn but has been necessary in the past for proper secure retention and control of the boot on the snowboard for "step-in" type binding attachments. A soft boot is far more comfortable for general recreational snowboarding, and this is the boot style of choice for the majority of the recreational snowboarders worldwide. The soft boot permits a normal walking movement when the user is walking in the boots when not connected to the snowboard where the hard boot restricts normal walking movement. In snowboarding applications, a soft boot also provides superior arch support, shock absorption and a soft foot bed that conforms to the shape of the rider's foot. A soft boot is easier for the rider to "skate" the snowboard across the snow. A normal walking movement for comfort requires a limited amount of bending movement of the sole with the sole being flexible. However, in the past, it has not been deemed to be possible to construct a soft boot to be utilized in conjunction with a "step-in" binding.

"Step-in" bindings, with skis and snowboards, have long been known. The "step-in" bindings of the prior art allow for a single step-in procedure with generally the procedure constituting the (1) toe of the boot engaging first by spearing the toe of the boot forward beneath a bridge, pushing the boot forward and then pivoting of the heel of the boot (toe then heel) to complete engagement with the binding system mounted on the snowboard, (2) straight down simultaneous engagement and (3) side-to-side engagement.

SUMMARY OF THE INVENTION

The primary objective of this invention is to construct a boot binding apparatus for a snowboard which will permit the rider to engage in three different manners, the first manner being heel then toe, the second manner being toe then heel and the third manner being heel and toe simultaneously.

A further objective of this invention is to allow the rider to easily engage the boot to the binding on any slope of terrain without having to reorientate the snowboard on the terrain.

A further objective of this invention is to allow the rider to easily engage the boot to the binding so the back of the boot abuts against the exterior highback without any adjustment of the highback.

A further objective is to create a "step-in" binding that utilizes a true soft boot.

With the boot binding system engaged with the snowboard boot, the sole of the boot is substantially in total flush contact with the upper surface of the base plate of the binding. In the toe to heel "step-in" bindings of the prior art where the securements are located under the sole of the boot, the snowboard boot is mounted to the binding with the boot assuming a slightly spaced position above the surface of the binding. This non-direct contact between the boot and the binding causes a wobbling type movement of the boot relative to the snowboard that is deemed to be undesirable. With the surface of the sole of the boot in direct contact with the upper surface of the binding, there is a fixed relationship (non-wobbling) between the boot and the binding so that both the boot and the snowboard operate as one together when the snowboard is moving across the snow. Also, the increased area of contact between the boot and the binding facilitates the application of slight precise movements that are required to turn the direction of the snowboard making such turning easier and quicker and provides the rider with a stable control surface providing phase reaction between the boot and the binding and superior shock absorption not found in the prior art.

Another objective of the present invention is that the binding mechanism between the boot and the snowboard is totally enclosed and is protected from contamination with snow or debris during operation of the snowboard. This contamination could affect the engagement and release procedure and subsequent reengagement of the binding apparatus as well as also affecting the flush interconnection between the sole of the boot and the upper surface of the snowboard.

Another objective of the present invention is to allow disengagement of the boot from the binding in a forward walking-like manner. When the release is activated, the heel of the boot is lifted and the toe is free to move forward away from the binding.

The boot binding apparatus of the present invention provides for a "step-in" binding while using of a true soft soled boot. The boot utilizes no stiffening shank imbedded in the sole and the boot upper has no internal rigid support structure. The sole of the boot is to rest directly onto the upper surface of the binding when the boot is securely engaged by the binding system of the snowboard. Latching mechanisms between the boot and the snowboard are totally enclosed and protected from contamination by snow and debris when the boot is engaged with the snowboard. The rear latching mechanism is continuously spring biased so such is always biased toward the latching position. The front latching mechanism may also be spring biased. Therefore, when operating of the snowboard, if there is an upward movement in a direction of the boot away from the snowboard, these biased latching mechanisms will actually more tightly engage to insure that the boot is prevented from accidental disengagement. The front hook member of the snowboard boot is to engage with the front latching mechanism mounted on the snowboard. The front latching member includes a front latching hook that faces directly toward the toe edge of the snowboard. The rear latching mechanism is to be movable between a latching position and an unlatching position by means of a pivotable cam which is connected to a manually operated handle. Flexing of the sole of the boot permits normal bending of the sole when skating and during walking and running movement when the snowboard boot is not engaged with the snowboard binding. The flexible sole provides comfortable arch support, soft foot bed cushioning and superior shock absorption.

DETAILED DESCRIPTION OF THE PREFERRED EMBODIMENTS

Figure 1:
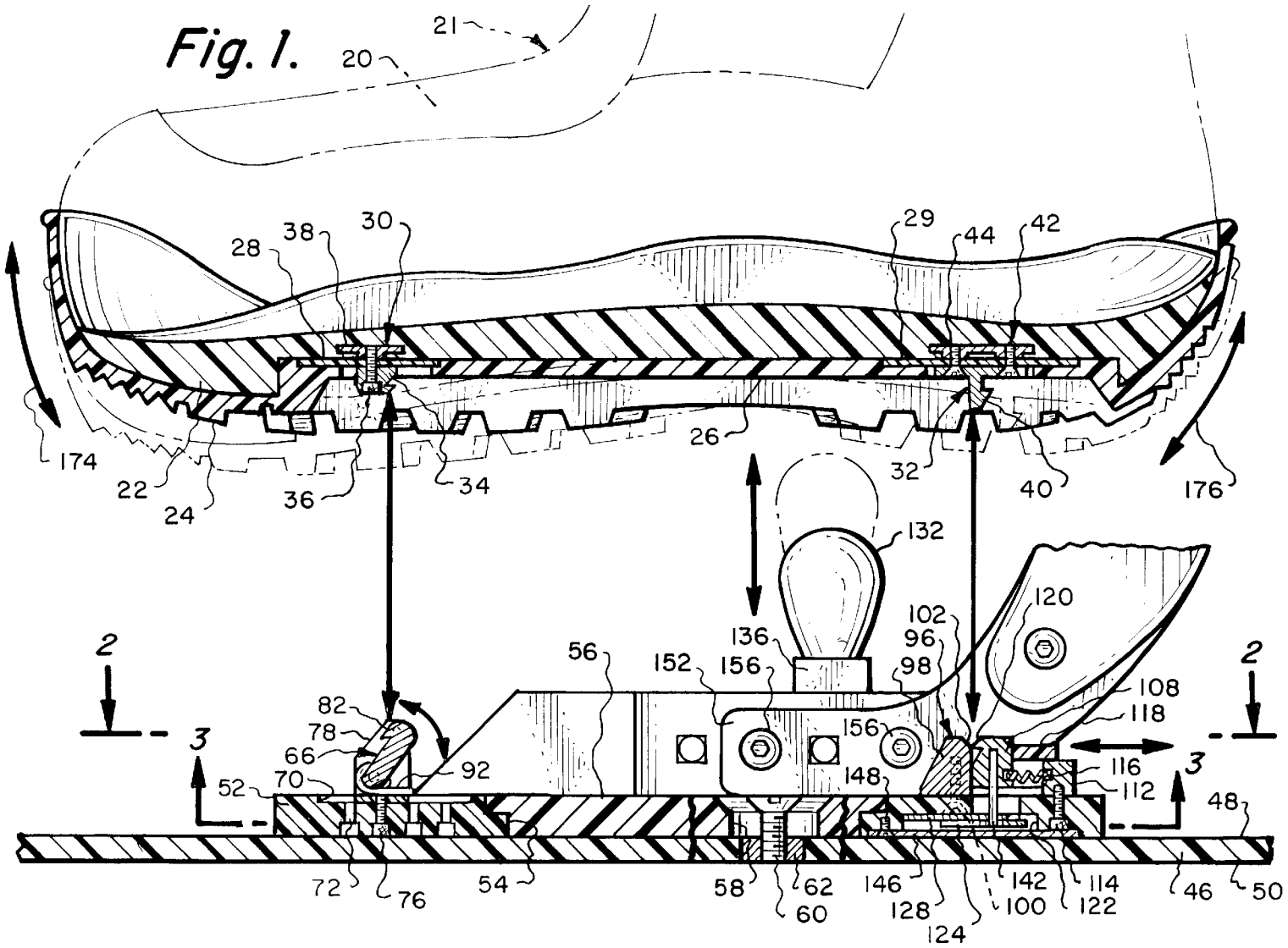
FIG. 1 is a cross-sectional, side, exploded view depicting straight down simultaneous engagement of both the hook members of a snowboard boot with the front latching mechanism and rear latching mechanism of the boot binding apparatus mounted on the snowboard and also showing the flexibility of the soft boot.
Figure 2:
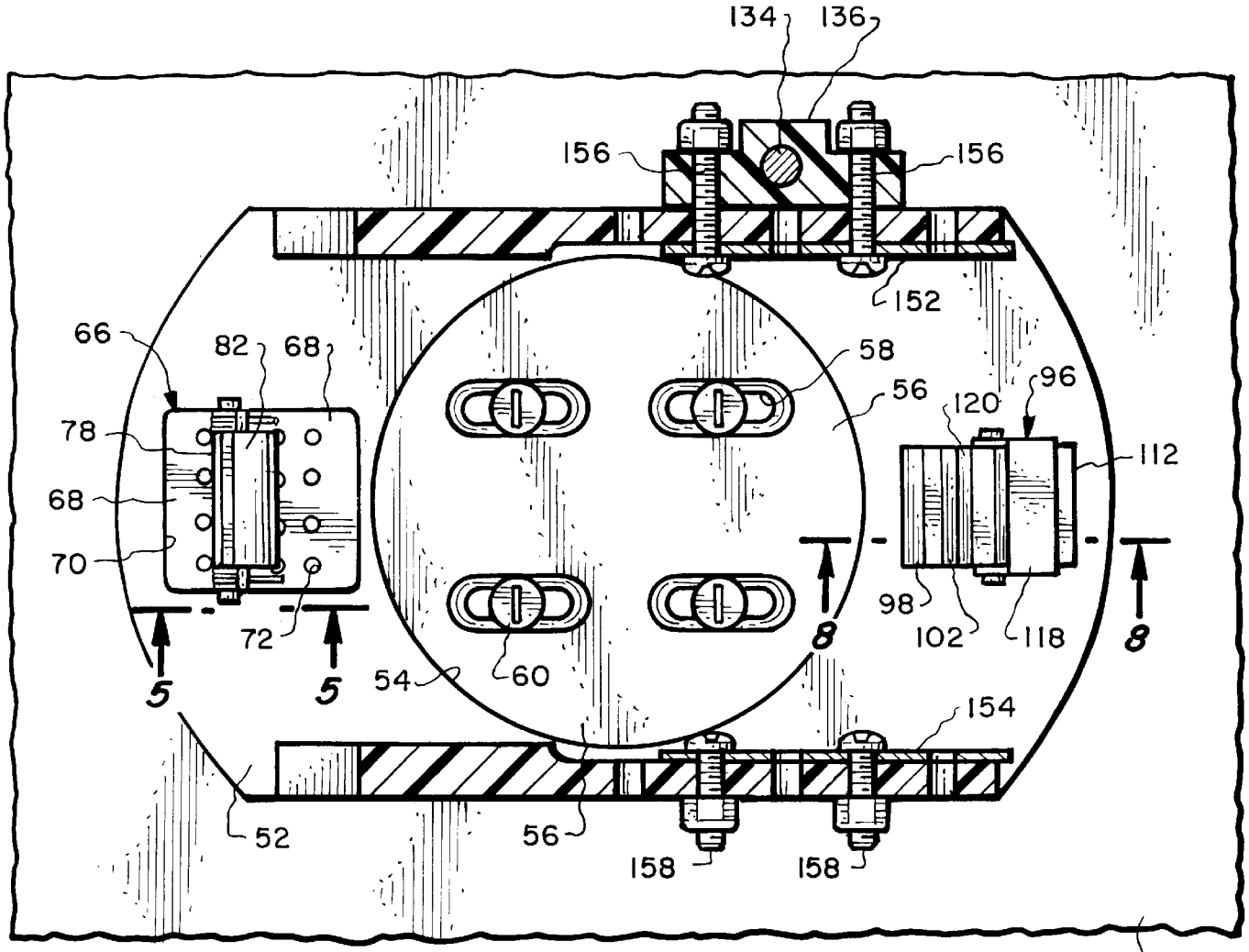
FIG. 2 is a top plan view of a portion of the boot binding apparatus mounted on the snowboard taken along line 2—2 of FIG. 1 with the boot binding apparatus being shown partly in cross-section.

Referring particularly to the drawings, there is shown an upper 20 of a boot 21 which is formed into a bottom, or lower surface, defined as the sole 22. Sole 22 includes an exterior hiatused surface defined as a tread configuration 24. Any particular tread configuration 24 could be utilized. The sole 22 includes an enlarged, centrally located recess 26. Imbedded within the sole 22 is a forward retention plate 28 and a rear retention plate 29. Attached to the forward retention plate 28 is a front hook member 30 also known as first securement. Attached to the rear retention plate 29 is a rear hook member 32 also known as second securement. The distance between the hook members 30 and 32 will change and be shorter in a smaller boot and greater in a larger size boot.

The front hook member 30 includes a hook shaped part 34 which is fixedly mounted by means of a plurality of bolts 36 to a T-plate 38 which is part of retention plate 28. The T-plate 38 is to be fixedly imbedded within the sole 22. The rear hook member 32 also includes a hook shaped part 40 which is fixedly mounted by bolts 42 to the rear retention plate 29 and T-shaped plate 44. Again, the T-shaped plate 44 is imbedded within the sole 22 and is part of the retention plate 29. Therefore, it is to be readily apparent that the hook shaped parts 34 and 40 can be separated from the sole 22 and then reengaged with the sole 22 by means of the bolts 36 and 42. It is to be noted that both the hook shaped parts 34 and 40 face in a rearward direction toward the rear of the boot 21.

A substantially planer snowboard 46 has a substantially planer upper surface 48 and a substantially planer lower surface 50. The lower surface 50 is to be moved across snow, which is not shown. A base plate 52 is to be located directly against the upper surface 48. The base plate 52 includes an enlarged, substantially centrally located hole 54. Located within the hole 54 is a circular disc 56. The disc 56 includes four in number of elongated holes 58. Located within each elongated hole 58 is a bolt fastener 60. Each bolt fastener 60 is threadably secured within a nut 62 (of which are four in number) which are fixedly mounted and imbedded within the snowboard 46. The bolt fasteners 60 can be loosened and the base plate 52 can be adjusted to a desired angular position on the upper surface 48. When the desired angular position is obtained, the bolt fasteners 60 are tightened thereby fixing in position the base plate 52. Normally, the longitudinal dimension of the base plate 52 will be located substantially transverse to the longitudinal center axis of the snowboard 46. Some particular riders prefer it in almost ninety degree position while other riders prefer some lesser angle, such as eighty or seventy degrees. Therefore, by using of the base plate 52, the disc 56 and the bolt fasteners 60, individual adjustment of the position of the base plate 52 on the snowboard 46 can be obtained.

It is to be understood that snowboard 46 is to include two in number of the base plates 52 located in a spaced apart manner. One base plate 52 is to be for the left boot 23 and the other base plate 52 is to be for the right boot 21 of the rider (see FIG. 16).

Figure 16:
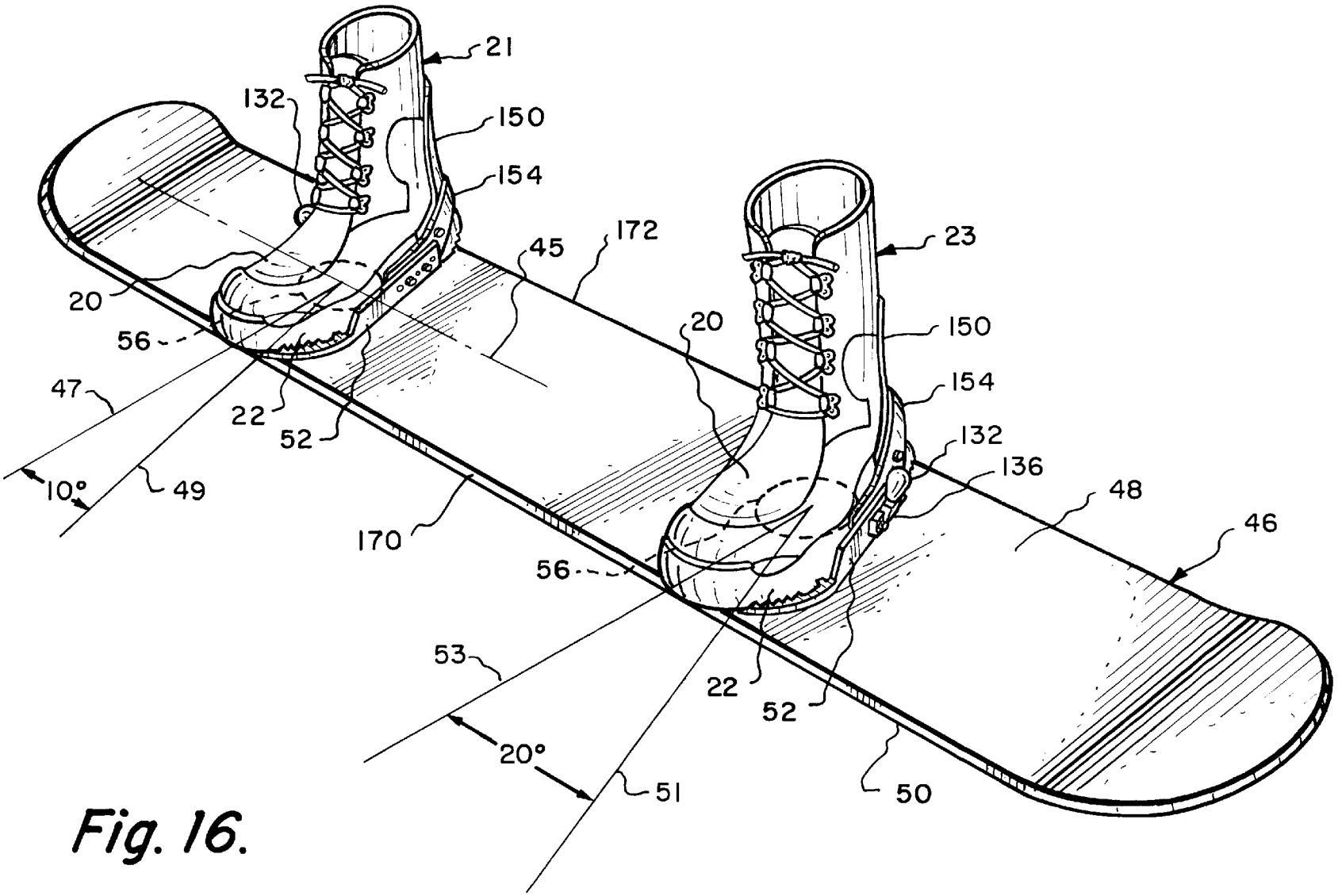
FIG. 16 is an isometric view depicting mounting of the snowboard binding of this invention in conjunction with boots and a snowboard.

Referring particularly to FIG. 16, there is depicted the right boot 21 and the left boot 23 being mounted on the opposite surface 48 of the snowboard 46. The snowboard 46 has a longitudinal center axis 45. The right angled direction 47 has the longitudinal dimension 49 of the boot 21 mounted offset in the forward direction. The boot 23 has its longitudinal dimension 51 offset about 20° from the right angled direction 53 from the longitudinal center axis 45. Both boots 20 and 23 face the toe edge 170 with the opposite edge of the snowboard 46 being called the heel edge 172. The toe edge 170 is located parallel to the heel edge 172 as is readily apparent within FIG. 16. Toe edge 170 is actually a side edge of the snowboard 46 as is also the heel edge 172 since the toe edge 170 and the heel edge 172 are along the longitudinal dimension of the snowboard 46.

Fixedly mounted onto the base plate 52 is a front latching mechanism 66. A rectangularly shaped cavity 70 is formed within the base plate 52. The rectangularly shaped cavity 70 connects with a series of holes 72. A plurality of bolts 76 are to align with a plurality of the holes 72 with bolts 76 being used to secure the U-shaped frame 78 of the front latching mechanism 66 to the base plate 52.

Figure 6:
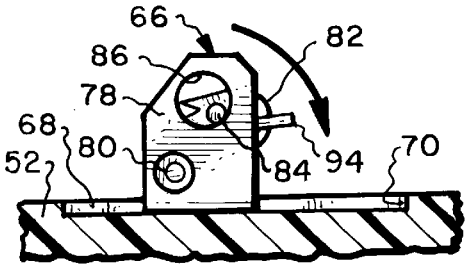
FIG. 6 is a view similar to FIG. 5 but showing the front latching hook in its rearwardmost biased position.
Figure 7:
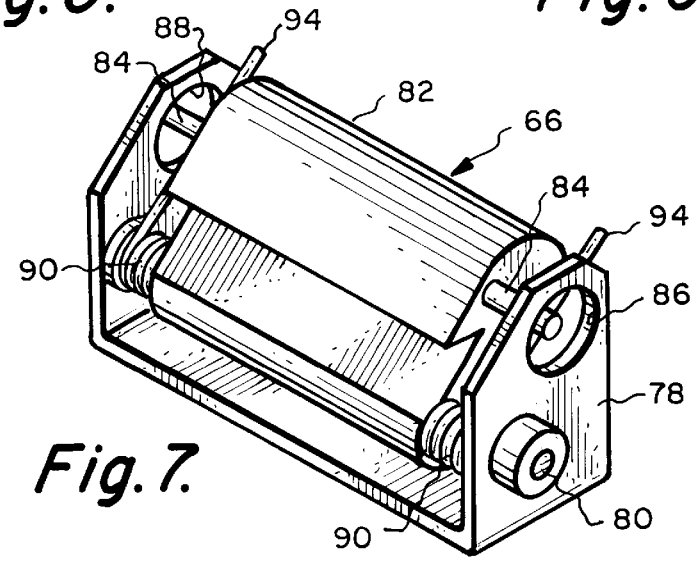
FIG. 7 is an isometric view of the front latching hook of FIGS. 5 and 6.

Mounted between the legs of the U-shaped frame 78 is a pivot pin 80. Pivotly mounted on the pivot pin 80 between the legs of the U-shaped frame 78 is a front latching hook 82. The front latching hook 82 also has a pin 84 which is conducted through the front latching hook 82 and is located parallel to the pivot pin 80. The pin 84 protrudes from each side of the front latching hook 82 with one end of the pin 84 being located within hole 86 and the other end of the pin 84 being located within hole 88 of the U-shaped frame 78. Mounted about the pivot pin 80 is a coil spring 90. The lower end 92 of the coil spring 90 rests against the U-shaped frame 78. The opposite end 94 of the coil spring 90, which is actually two separate members 94, are each to abut against a respective protruding end of the pin 84. It is the function of the coil spring 90 to exert a continuous bias tending to locate the front latching hook 82 in the latching position, which is shown in FIGS. 1, 5, 10 and 11. The front latching hook 82 is to be pivotable to a displaced position as shown in FIG. 6. The angular movement from the latched position to the displaced position is defined by the physical size of the holes 86 and 88, which are of the same size, and the pin 84 which moves from one position within the holes 86 and 88 to another position.

Figure 8:
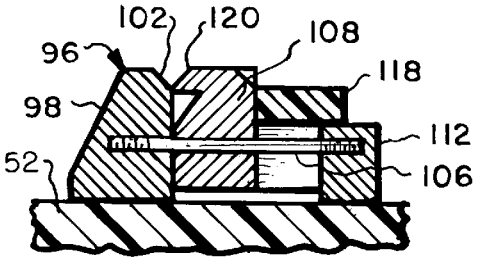
FIG. 8 is a cross-sectional view through the rear latching mechanism of the boot binding apparatus of this invention taken along line 8—8 of FIG. 2 showing the rear latching mechanism in the latching position.
Figure 9:
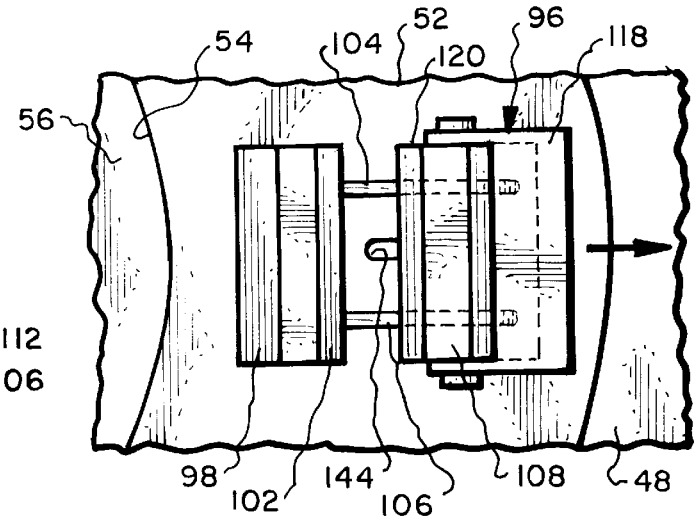
FIG. 9 is a top plan view of the rear latching mechanism of FIG. 8 showing the rear latching mechanism in the unlatching position.
Figure 10:
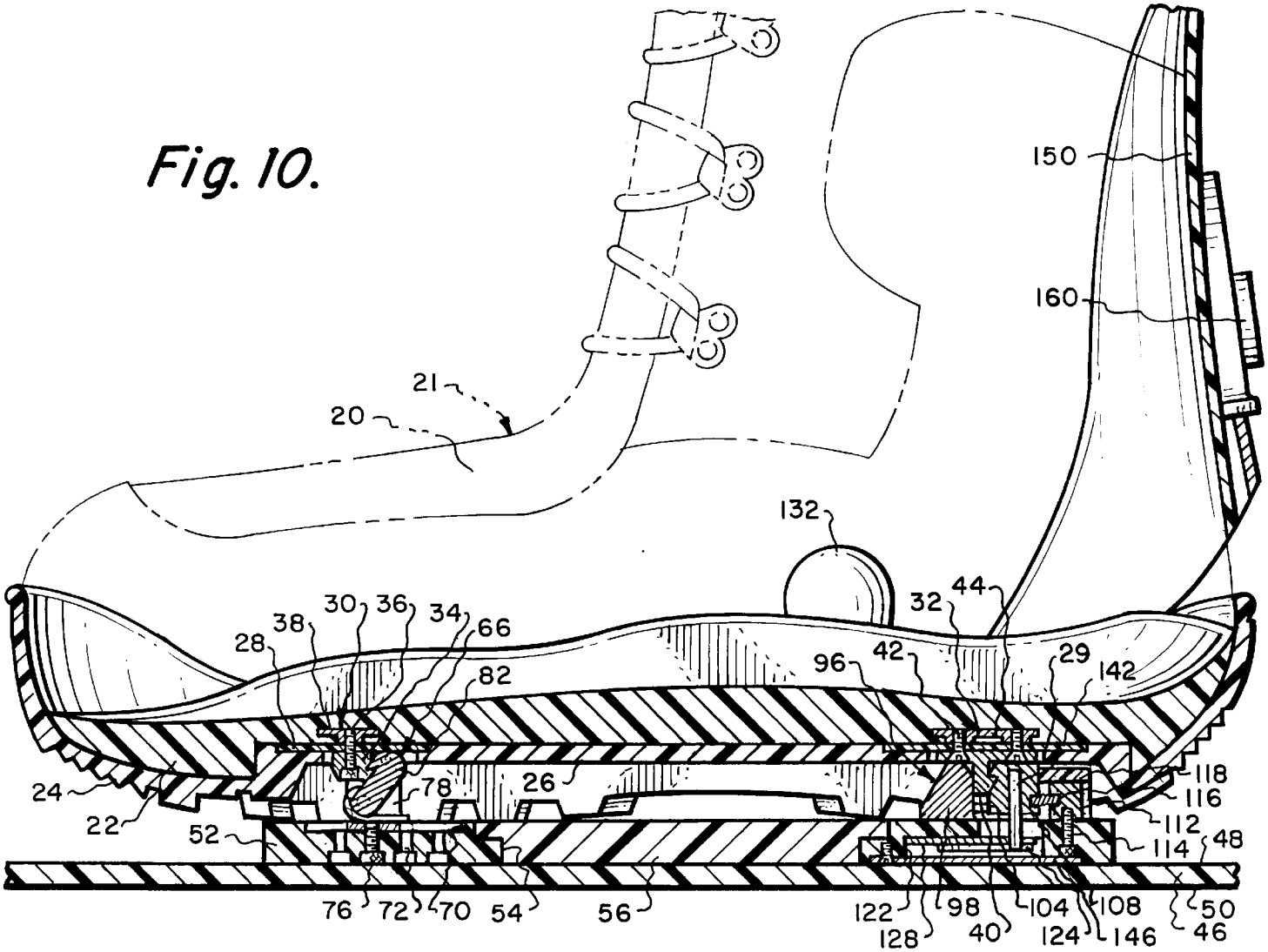
FIG. 10 is a cross-sectional view similar to FIG. 1 but showing the snowboard boot securely mounted in conjunction with the boot binding apparatus.

Also mounted on the base plate 52 is a rear latching mechanism 96. The rear latching mechanism 96 includes a block 98. The block 98 is fixedly mounted by bolts 100 to the base plate 52. Block 98 has an upper chamfered edge 102. A pair of horizontal pins 104 and 106 are fixedly mounted within the block 98 with the pins 104 and 106 extending in a direction substantially parallel to the upper surface 48. A rear latching hook 108 is supported on the horizontal pins 104 and 106. The rear latching hook 108 is capable of being movable along the length of the pins 104 and 106. This movement is limited by a rear block 112 which is also fixedly mounted by bolts 114 onto the base plate 52. The amount of movement permitted by the rear latching hook 108 is the length of the space that is provided between block 98 and rear block 112. Mounted between the rear block 112 and the rear latching hook 108 is a coil spring 116. The coil spring 116 exerts a continuous bias tending to locate the rear latching hook 108 in the position shown in FIG. 8 of the drawings, that is abutting against the block 98. A cover plate 118 is secured to the rear latching hook 108 and moves with the rear latching hook 108. The cover plate 118 rides on the upper surface of the rear block 112. The purpose of the cover plate 118 is to prevent contamination of the coil spring 116 with snow and/or debris. The rear latching hook 108 also includes an upper chamfered edge 120. The purpose of the upper chamfered edges 102 and 120 will be explained further on in the specification.

It is noted that in order to tightly mount the back 21 onto the snowboard 46, there must be used at least two (in number) of separate, spaced apart securing devices such as the front latching mechanism 66 and the rear latching mechanism 96. However, some other securing device (not shown) could be used instead of the rear latching mechanism 96 in conjunction with the front latching mechanism 66. The other securing device and the rear latching mechanism 96 function to prevent the boot 21 from shifting and keeps the boot 21 tightly engaged with the front latching mechanism 66.

Formed within the bottom surface of the base plate 52 is a cavity 122. Located within the cavity 122 is a cam 124. The cam 124 is pivotly mounted by a pivot pin 126 to the base plate 52. The inner leg of the cam 124 is connected to a cable 128. The cable 128 is conducted through a through opening 130 formed in the base plate 52 and connects to a handle 132. The handle 132 includes a rod 134 which is secured to the cable 128. The rod 134 is movably mounted within a support block 136 which is fixedly mounted onto the side wall of the base plate 52.

Figures 3, 4:
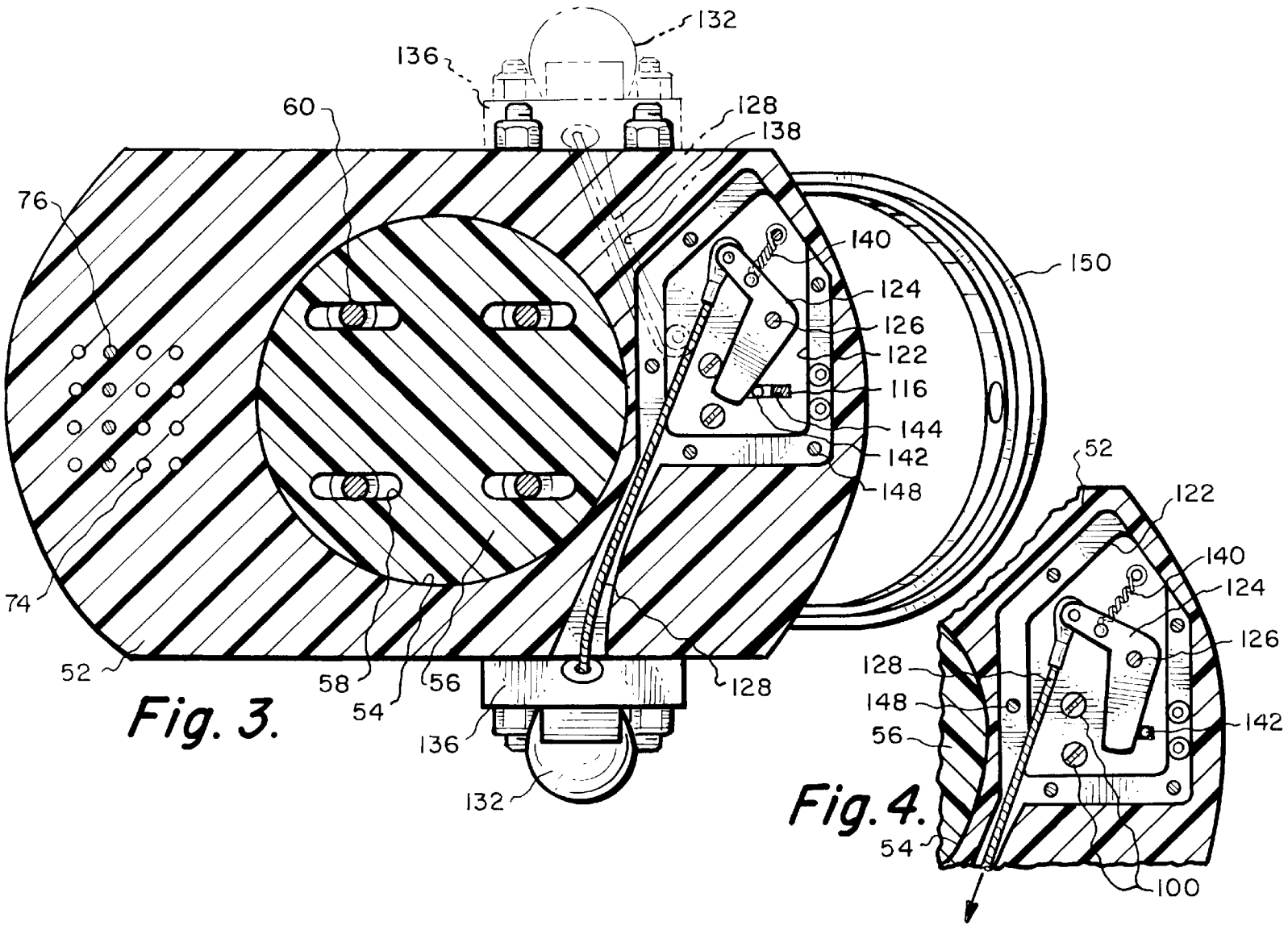
FIG. 3 is a bottom cross-sectional view through the boot binding apparatus of this invention taken along line 3—3 of FIG. 1 showing an unlatching of cam mechanism in the position with the rear latching mechanism in the latched position.
FIG. 4 is a cross-sectional view of a cam mechanism that is usable to move the rear latching mechanism of the snowboard from a latching position to an unlatching position showing the cam in its position with the rear latching mechanism in the unlatched position.
Figure 5:
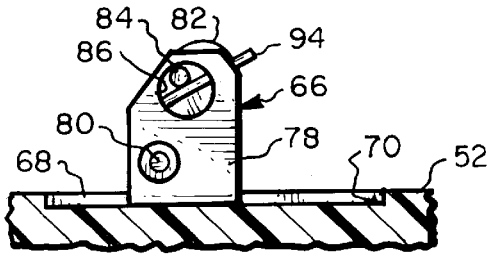
FIG. 5 is a side elevational view of the front latching mechanism of the boot binding system taken along line 5—5 of FIG. 2 showing the front latching hook in its forwardmost biased position.

It is considered to be within the scope of this invention that the position of the support block 136 can be varied, such as being located on the opposite side of the base plate 52 as is clearly shown in phantom lines in FIG. 3. This will mount the handle 132 to a different position on the base plate 52. According to individual preference, one snowboard rider may choose the mounting in phantom lines shown in FIG. 3 while another snowboard rider would choose the solid line mounting shown in FIG. 3. In the phantom line position shown in FIG. 3, the cable 128 is conducted through a through opening 138 formed in the base plate 52.

The upper leg of the cam 124 is connected to one end of a coil spring 140. The opposite end of the coil spring 140 is fixedly mounted to the base plate 52. The lower end of the cam 124 abuts against a vertical pin 142. The vertical pin 142 is fixedly mounted to the rear latching hook 108. The vertical pin 142 is conducted through an elongated hole 144 formed within the base plate 52. Normally, the cavity 122 is covered by a cover plate 146 which is secured to the base plate 52 by means of a plurality of screw fasteners 148. The cover plate 146 is to prevent any snow, liquid or debris from entering within the cavity 122.

As part of riding a snowboard, it is normally desirable to provide a support for the rear portion of the lower leg of the rider. This support is accomplished by providing a highback support plate 150. This highback support plate 150 is basically cup-shaped on its inner surface and defines a pair of forwardly extending legs 152 and 154. The legs 152 are fixedly secured to one of the sidewalls of the base plate 52 by means of bolts 156. The bolts 156 are also to securely mount support block 136 onto the base plate 52. The bolts 158 are used to fixedly secure the forward extending leg 154 to the opposite sidewall of the base plate 52. The position of the highback support plate 150 can be adjusted by an adjusting mechanism 160, which is deemed to be conventional and forms no specific part of this invention. A substantial area of support is required for the rider especially when initiating a heel side turn. In order to accomplish this, the rider has to lean rearwardly, and when doing that rearward leaning, a substantial area of contact is desired. It is for this reason that the highback support plate 56 is included with the base plate 52.

Figure 13:
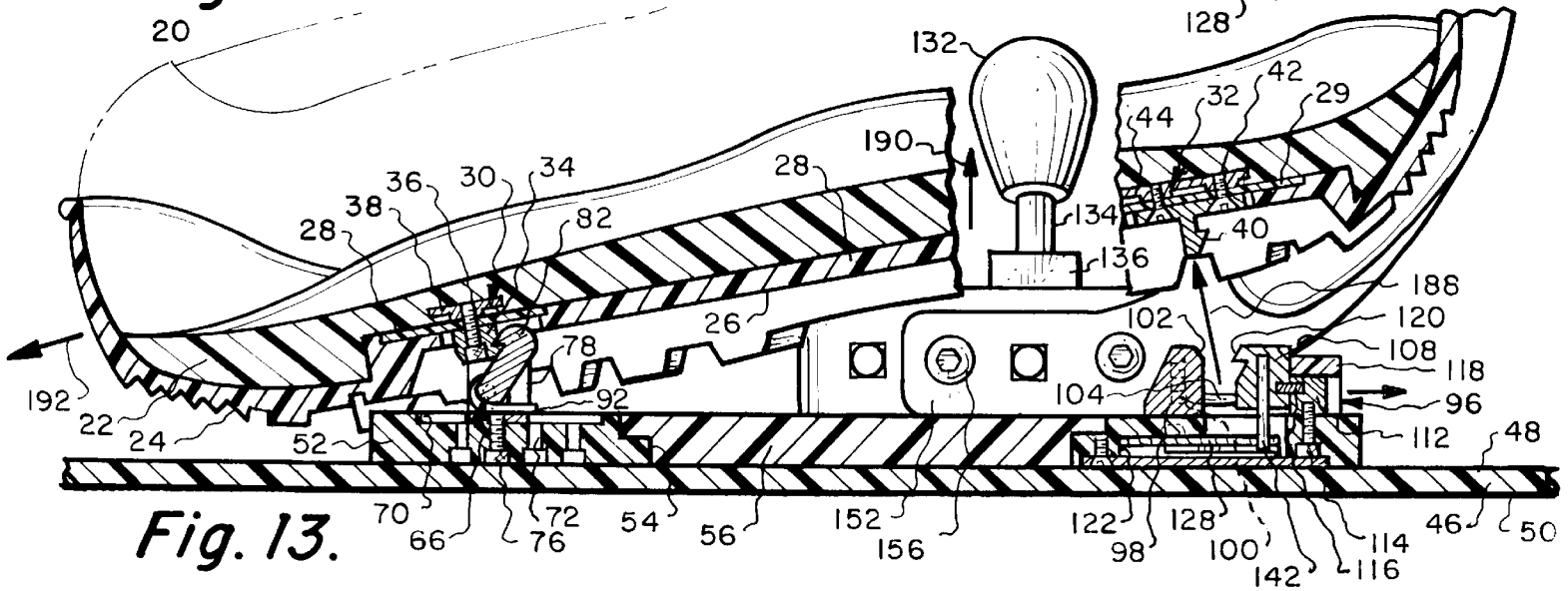
FIG. 13 is a cross-sectional view similar to FIG. 12 depicting a heel then toe forward disengagement procedure of the boot relative to the boot binding system.
Figure 14:
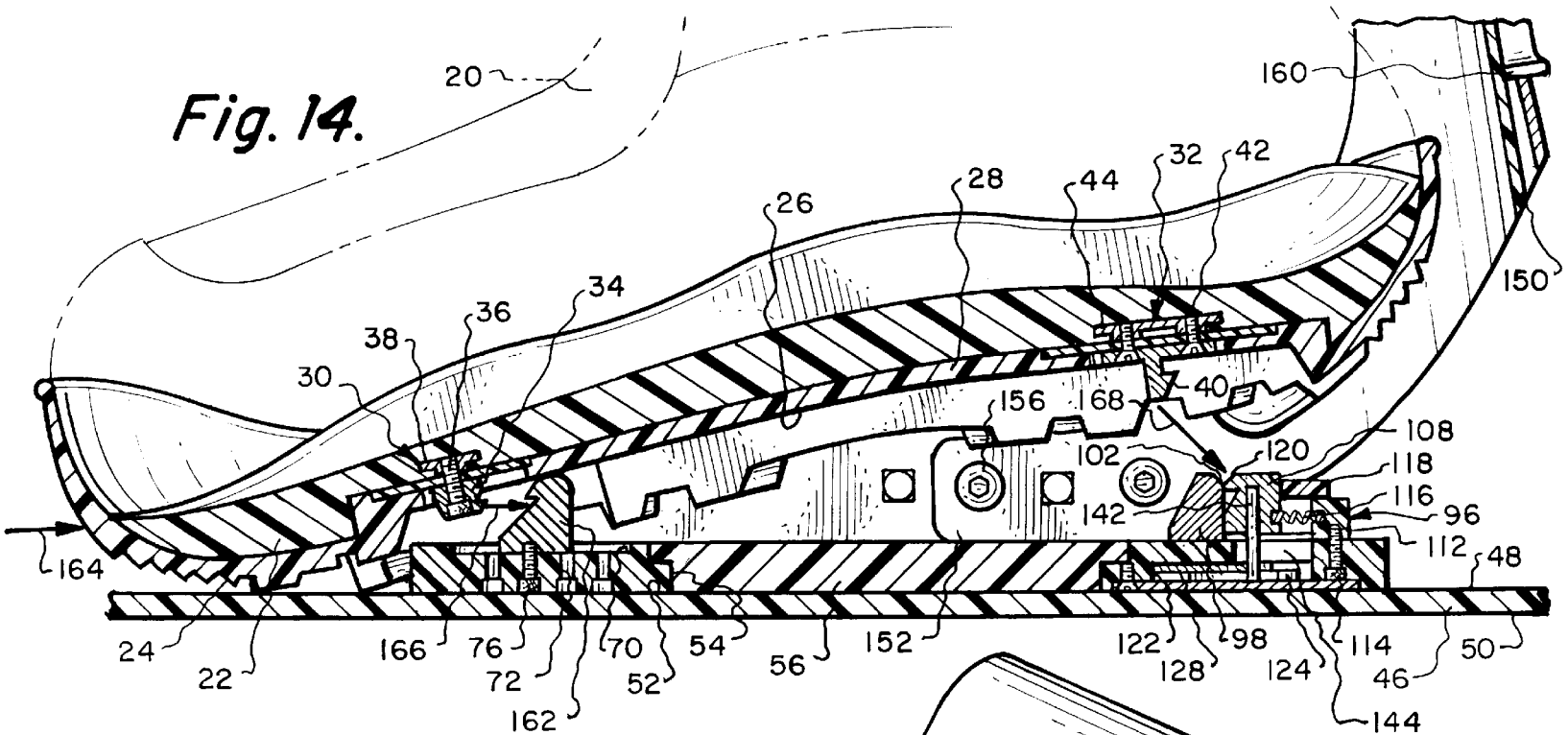
FIG. 14 is a view similar to FIG. 12 but where the front latching mechanism mounted on the snowboard comprises a fixed member and is not movable as is shown in FIG. 12.
Figure 15:
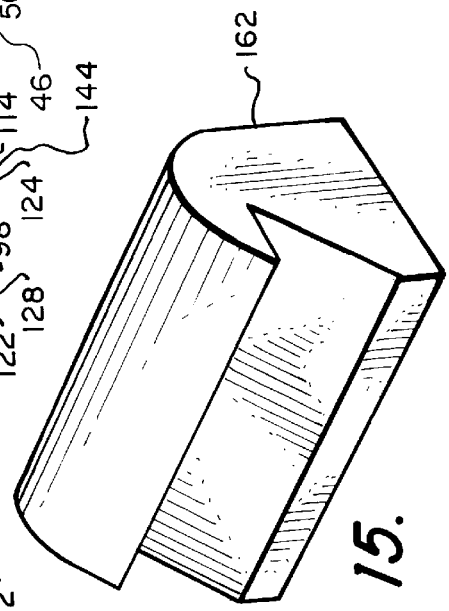
FIG. 15 is an isometric view of the fixed version of front latching mechanism that is to be mounted on the snowboard in FIG. 14.

Referring particularly to FIGS. 14 and 15 of the drawings, there is shown a modification wherein instead of the front latching mechanism 66, there is utilized a fixed version of front latching mechanism in the form of a hook shaped part 162. This hook shaped part 162 is securely mounted by the bolts 76 to the base plate 52. In this version shown in FIGS. 14 and 15, the only step-in procedure that will be permitted is a toe then heel step-in procedure. Within the embodiment shown in FIGS. 1–13, not only can a toe then heel step-in procedure be utilized but also a heel then toe and where both the toe and the heel are engaged simultaneously. In the embodiment shown in FIGS. 14 and 15, the disengagement procedure of the boot is heel first and then toe with the boot then moving in a direction away from the highback support plate 150. In FIG. 14, the arrows 164, 166 and 168 are used to indicate the engaging procedure which would be toe then heel. It is to be noted that in the embodiment shown in FIG. 14 the hook member 162 is again positioned so that it faces toward the toe edge 170 of the snowboard 46 rather than toward the heel edge 172. Referring particularly to FIG. 1, it is to be observed that the sole 22 is deemed to be bendable or flexible as in a conventional shoe or boot. This bending or flexing is depicted in phantom lines with this bending or flexing movement being represented by the arrows 174 and 176. Some limited bending or flexing of the sole 22 occurs during riding of the snowboard 46. This bending or flexing of the sole 22 is to occur when the rider is not engaged to the snowboard 46 and is walking, running or skating in the boots. Skating is defined as when the front foot of the rider is attached to the snowboard 46 and the rear foot is detached so as to propel the rider across the snow.

Figure 11:
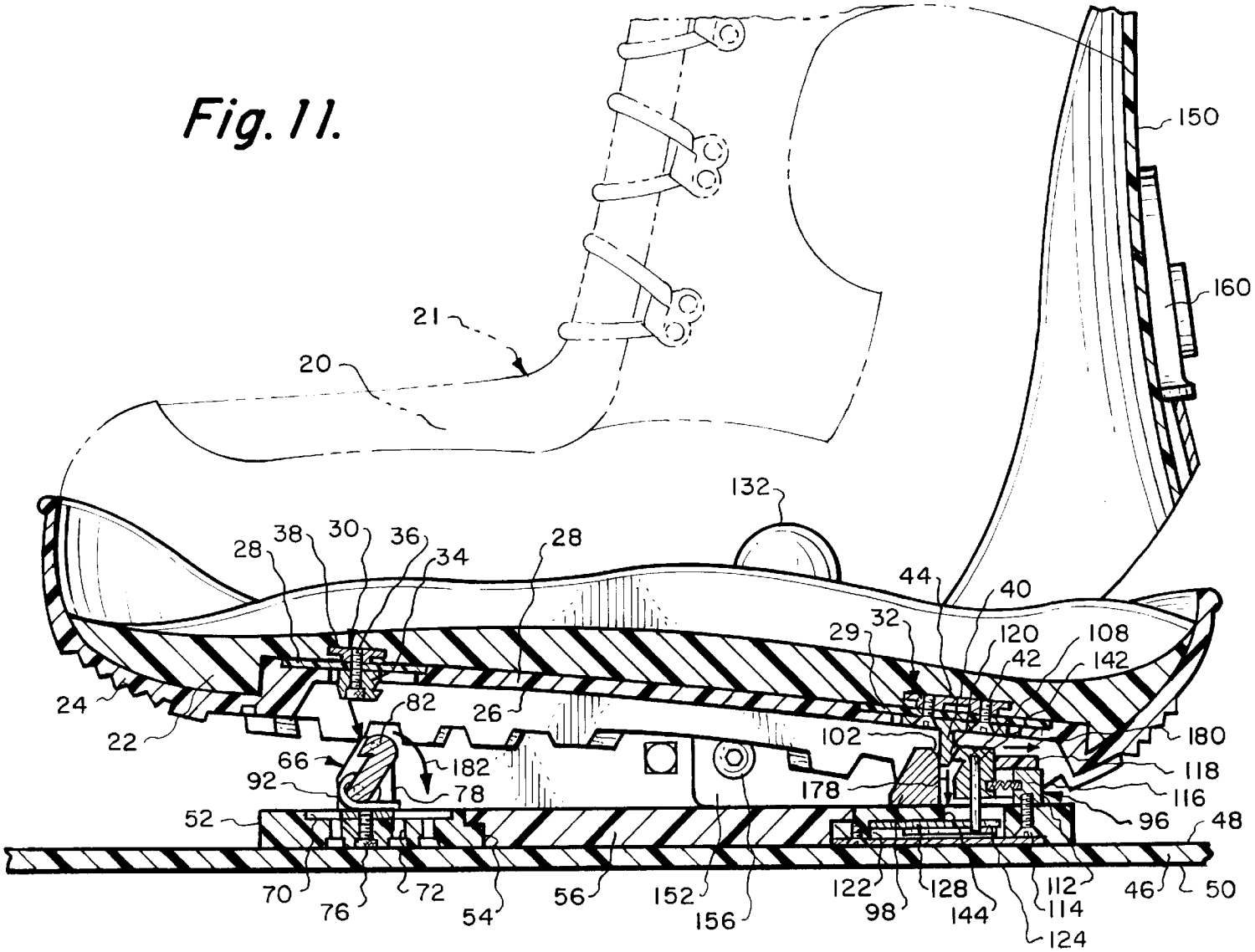
FIG. 11 is a cross-sectional view similar to FIG. 10 depicting a heel then toe engagement procedure of the boot with the boot binding system.

The heel then toe engaging procedure is depicted generally in FIG. 11. The hook shaped part 40 is placed in contact with the upper chamfered edges 102 and 120, and upon applying a downward pressure in the direction of arrow 178, the rear latching hook 108 will move rearwardly in the direction of arrow 180. When adequate clearance is provided, the hook shaped part 40 will move to a lower position and be locked in place by rear latching hook 108. Rear latching hook 108 will have moved in the direction of arrow 180 compressing spring 116, and once the hook shaped part 40 is at the desired lowermost position, the rear latching hook 108 will then move in a direction opposite the arrow 180 thereby locking in position rear latching hook 108 with the hook shaped part 40.

At this time, the user is to pivot the boot in a counterclockwise direction causing the hook shaped part 34 to abut against the front latching hook 82 of the front latching mechanism 66. This will cause the front latching hook 82 to be pivoted in the direction of arrow 182 until hook shaped part 34 is moved to its displaced position at which time front latching hook 82 will then pivot in a direction opposite arrow 182 to lockingly engage with hook shaped part 34. At this time, the sole 22 is firmly secured to the base plate 52.

Figure 12:
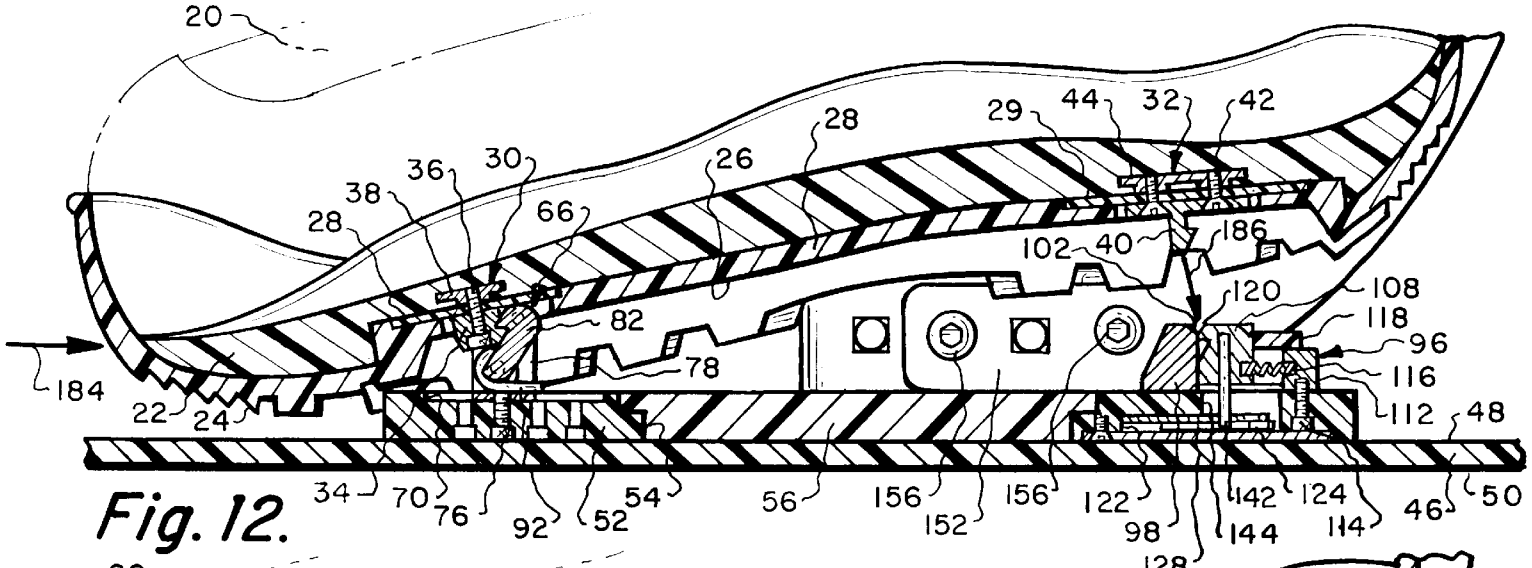
FIG. 12 is a cross-sectional view similar to FIG. 11 depicting a toe then heel engagement procedure of the boot with the boot binding system.

Referring particularly to FIG. 12, instead of the heel then toe securing procedure, the rider will have the option to first place into engagement the hook shaped part 34 and front latching hook 82 as indicated by arrow 184. The rider will then pivot clockwise the boot 21 in the direction of arrow 186 causing, again, the hook shaped part 40 to press against the upper chamfered areas 102 and 120 and cause the rear latching hook 108 to move rearwardly against the bias of the spring 116 permitting the hook shaped part 40 to be moved to a lower position and then be engaged by the rear latching hook 108.

Referring particularly to FIG. 13, the disengaging procedure is depicted. The rider is to physically grasp the handle 132 and pull in an upward direction as indicated by arrow 190. The cable 128 will then cause the cam 124 to pivot counterclockwise stretching the spring 140 and applying pressure against the vertical pin 142 which will result in the rear latching hook 108, to which it is attached, being moved rearwardly against the bias of the spring 116. When the rear latching hook 108 has been moved to the position as shown in FIG. 13, the hook shaped part 40 can then be moved upwardly in a disengaging direction as depicted by arrow 188. With the hook shaped part 40 in the position shown in FIG. 13, the rider can then move the boot 21 forwardly in the direction of arrow 192 which will then result in disengaging of hook shaped part 34 and front latching hook 82 with the boot 21 now being completely disengaged from the snowboard 46.

The structure of the present invention provides a snowboard binding system that, when engaged, becomes torsionally rigid with no heel or toe lift with maximum control surface in the area of the sole 22. This "stiffness while engaged" is accomplished while maintaining the shock absorbing, comfort and performance principles of a conventional soft boot. The soft boot is further advantageous when skating to the lift line and walking/ running when not engaged with the snowboard 46. Skating is defined when the rider disengages the rear boot only using this now free boot to propel the snowboard and the attached other boot across the snow when entering and leaving lift lines and when traversing flat terrain.

It is considered to be within the scope of this invention that sole 22 could include a stiff shank, but the preferred arrangement would be to not include such a shank so that a soft boot is obtained. The construction of the boot 21, within the present invention, achieves lower cost boot manufacturing because the boot 21 does not require any molded parts such as a stiff shank or internal highbacks to be inserted within the boot, and the boot can be molded utilizing three different grades of polyurethane, the first grade being used for the outer sole 22 of the boot 21 with the outer sole 22 then being molded around the second grade of polyurethane, which is comprised of the polyurethane retention plates 28 and 29, and the third grade of polyurethane being used as the cushion material which is to be contacted directly beneath the rider's feet. All three densities of polyurethane melt together without the use of any glue thereby further reducing the cost of manufacturing in the molding process. Also, no glue means there is a tight seal for all layers with no chance of water penetration and less labor for assembly. Prior art stiff shanks within boots require a gluing process.

Another feature of the present invention is to create a boot and binding that has a custom alignment for each boot size. This is accomplished by permitting adjusting of the U-shaped frame 78 to various positions provided by holes 72 increasing the spacing from the rear latching mechanism 96 or decreasing the spacing. Also, position of the highback support plate 150 is to be adjusted by loosening of the bolts 156 and 158 and moving of the highback support plate 150 relative to the base plate 52 and then retightening of the bolts 156 and 158. The holes incorporated within the highback support plate 150 which engage with the bolts 156 and 158 are to be oversize, which are not shown in the drawing. The combination of these adjustments allows precise centering of each binding to the ball and heel of each foot. Each individual boot is to have the front latching mechanism 66 located underneath the anatomical ball of the foot of the rider, and the rear latching mechanism 96 located directly under the heel of the foot of the rider. Sizing can be done in the manufacturing process at the boot factory.

Within the embodiment shown in FIGS. 1–13, because both the front latching mechanism 66 and the rear latching mechanism 96 are both spring biased, such apply a constant force on their respective connected hook members. When the boot flexes and or compresses under the force of the rider's movements, spring biasing maintains constant contact with no "play" while engaged. When the boot 21 experiences an upward or downward force from the rider's feet, the latching mechanisms 66 and 96 maintain constant contact with hook shaped parts 34 and 40 respectively.

The toe facing orientation of front latching hook 82 in combination with rear facing hook shaped part 34 accommodates a true soft boot "safely" without any chance of disengagement where prior art bindings must have a stiff shank to achieve effective retention of the boot 21 to the binding.

It is to be noted that the hook shaped parts 34 and 40 both face in the rearward direction, that is toward the highback support plate 150. This rear positioning of the hook shaped parts 34 and 40 limits potential snow contamination during normal skating, walking and running with the boot 21 thereby minimizing collection of snow within the recess 26.

The handle 132 requires a straight up pull force to achieve ease of release for the disengaging movement. Also, a strap could be attached to the handle 132 and extended up to the rider's waistline and/or neckline for emergency release by the rider.

Another objective of the present invention is to create a snowboard binding where all the parts are connected by screws and bolts. This makes repair and replacement convenient. It also permits removing of the front and rear hook shaped parts 34 and 40 for placement onto a second boot.

The boot binding of the present invention, when completely engaged with the boot 21, has all the mechanisms completely contained interiorly in the contact area of the sole 22. The only exposed part is the handle 132, and the handle 132 is pulled upward and away from any snow piled up on the snowboard binding and the snowboard 46 thereby making the entire mechanism completely clog proof when engaged. No snow clearing will be required to effect disengagement. Every other mechanism within the prior art to some degree has exposed mechanical structures that become contaminated with snow thereby making disengagement potentially difficult.

What is claimed is:

1. A system for attaching a snowboard boot to a snowboard comprising:

a snowboard boot having a toe end, a heel end, a sole, and front and rear longitudinally spaced securement members fixedly attached to the sole proximate the toe and heel ends, respectively, and depending therefrom, each of the front and rear securement members being formed with a recessed portion having an opening;

a base plate for attachment to an upper surface of the snowboard;

a front latching mechanism for engagement with the front securement member, said front latching mechanism including a front latching hook having a vertical portion with a lower end mounted to the base plate for movement about an axis extending transverse to a longitudinal axis of the boot and a horizontally extending hook portion formed at an upper end of the vertical portion, the hook portion extending in a direction towards the toe end of the boot and received within the recessed portion of the front securement member when the boot is attached to the binding, at least the hook portion of the front latching hook being biased in a direction towards the toe end of the boot for maintaining the hook portion within the recessed portion;

a rear latching mechanism for engagement with the rear securement member, said rear latching mechanism including a rear latching hook movably mounted to the base plate for movement between a release position and a latched position, the rear latching hook being biased into locking engagement with the rear securement member while in the latched position; and a manual release mechanism operatively connected only to the rear latching mechanism for moving the rear latching hook to it's release position, wherein upon movement of the rear latching hook to the release position, the front securement member is releasable from the front latching mechanism by forward movement of the snowboard boot relative to the base plate.

2. A boot binding system as defined in claim 1, wherein the rear latching hook is positioned between the rear securement member and the heel end of the snowboard boot.

3. A boot binding system as defined in claim 1, wherein said rear latching mechanism includes a block member fixedly mounted to the base plate, said rear securement member being received between said block member and said rear latching hook while in the latched position.

4. A boot binding system as defined in claim 3, wherein the rear latching hook includes a hook portion which is received within the recessed portion of the rear securement member while in the latched position.

5. A boot binding system as defined in claim 1, wherein the sole of the boot is flexible for permitting flexure about a transverse axis at least along a mid-portion of the sole extending longitudinally between the front and rear securement members.

6. A binding system for attaching a snowboard boot to a snowboard comprising:

a snowboard boot having a toe end, a heel end, a sole, and front and rear longitudinally spaced securement members fixedly attached to the sole proximate the toe and heel ends, respectively, and depending therefrom, each of the front and rear securement members being formed with a recessed portion having an opening;

a base plate for attachment to an upper surface of the snowboard;

a front latching mechanism for engagement with the front securement member, said front latching mechanism including a front latching hook having a vertical portion with a lower end mounted to the base plate for movement about an axis extending transverse to a longitudinal axis of the boot and a horizontally extending hook portion formed at an upper end of the vertical portion, the hook portion extending in a direction towards the toe end of the boot and received within the recessed portion of the front securement member when the boot is attached to the binding, the front latching hook being biased in a direction towards the toe end of the boot for maintaining the hook portion within the recessed portion;

a rear latching mechanism for engagement with the rear securement member, said rear latching mechanism including a block member fixedly mounted to the base plate and a rear latching hook having a vertical portion mounted to the base plate for movement between a release position and a latched position, and a horizontally extending hook portion formed at an upper end of the vertical portion, the hook portion extending in a direction towards the block member, the rear securement member being receivable between the rear latching hook and the block member with the rear latching hook received within the recessed portion of the rear securement member when in the latched position, the rear latching hook being biased to the latched position in a direction towards the block member; and a manual release mechanism operatively connected only to the rear latching mechanist for moving the rear latching hook to it's release position.

7. The boot binding system as defined in claim 6 wherein:

said rear latching mechanism being continuously biased by a first biasing means toward said latching position.

8. The boot binding system as defined in claim 6 wherein:

said front latching mechanism being movable, said front latching mechanism being continuously biased by a second biasing means, said second biasing means continuously biasing said hook member toward said toe edge.

9. The boot binding system as defined in claim 6 wherein:

a pivotable cam being mounted in conjunction with said boot binding system, said pivotable cam being connected to said rear latching mechanism of said snowboard, said pivotable cam also connecting to a manually graspable handle, said manually graspable handle to be manually movable causing pivoting of said cam and moving of said rear latching mechanism from said latching position to said unlatching position.

* * * * *